US008061965B2

(12) United States Patent
Daeubler et al.

(10) Patent No.: US 8,061,965 B2
(45) Date of Patent: Nov. 22, 2011

(54) RING STRUCTURE OF METAL CONSTRUCTION HAVING A RUN-IN LINING

(75) Inventors: Manfred A. Daeubler, Dachau (DE); Horst Mueller-Wittek, legal representative, Gelsenkirchen (DE); Renate Mendritzki, legal representative, Gelsenkirchen (DE); Ulrike Hain, Munich (DE); Werner Humhauser, Moosburg (DE)

(73) Assignee: MTU Aero Engines GmbH, Munich (DE)

( * ) Notice: Subject to any disclaimer, the term of this patent is extended or adjusted under 35 U.S.C. 154(b) by 829 days.

(21) Appl. No.: 11/578,862

(22) PCT Filed: Feb. 28, 2005

(86) PCT No.: PCT/DE2005/000333

§ 371 (c)(1), (2), (4) Date: Oct. 18, 2006

(87) PCT Pub. No.: WO2005/085600

PCT Pub. Date: Sep. 15, 2005

(65) Prior Publication Data

US 2009/0263239 A1 Oct. 22, 2009

(30) Foreign Application Priority Data

Mar. 3, 2004 (DE) ..... 10 2004 010 236

(51) Int. Cl.
*F01D 11/08* (2006.01)

(52) U.S. Cl. ..... 415/9; 415/173.4; 415/174.4

(58) Field of Classification Search ..... 415/9, 173.1, 415/173.4, 174.4; 416/174
See application file for complete search history.

(56) References Cited

U.S. PATENT DOCUMENTS 3,042,365 A * 7/1962 Curtis et al. ..... 415/173.4
(Continued)

FOREIGN PATENT DOCUMENTS

DE 1 551 183 4/1970
(Continued)

OTHER PUBLICATIONS

Serope Kalpakjian and Steven R. Schmid, Manufacturing Processes for Engineering Materials, 2003, Prentice Hall, 4th Edition, pp. 689, 730.*

*Primary Examiner* — Edward Look
*Assistant Examiner* — Aaron R Eastman
(74) *Attorney, Agent, or Firm* — Davidson, Davidson & Kappel, LLC

(57) ABSTRACT

A ring structure with a metal design for a moving blade of axially flowed through compressor and turbine stages, particularly in gas turbine engines is provided. The ring structure includes a circular ring-shaped outer wall, a circular ring-shaped inner wall, which is located at a short radial distance from the moving blade tips, and includes a joining structure provided in the form of hollow chamber structure between the outer wall and the inner wall. The outer wall is provided in the form of a closed, mechanically stable housing wall of the compressor or turbine stage, and the joining structure provided in the form of hollow chamber structure is joined in a fixed manner to the outer wall and to the inner wall, for example, by soldering, diffusion welding or other joining techniques. The inner wall is provided in the form of a closed, mechanically stable structure, which serves as a run-in lining for the moving blade tips and which is made of a metal woven fabric and/or of a metal felt.

13 Claims, 1 Drawing Sheet

U.S. PATENT DOCUMENTS

| | | | | | |
|---|---|---|---|---|---|
| 3,053,694 | A | * | 9/1962 | Daunt et al. | 427/230 |
| 3,056,583 | A | * | 10/1962 | Varadi et al. | 415/209.2 |
| 3,068,016 | A | * | 12/1962 | Dega | 277/406 |
| 3,126,149 | A | * | 3/1964 | Bowers, Jr. et al. | 415/173.4 |
| 3,146,992 | A | * | 9/1964 | Farrell | 415/12 |
| 3,365,172 | A | * | 1/1968 | Howald et al. | 415/117 |
| 3,423,070 | A | * | 1/1969 | Corrigan | 415/200 |
| 3,425,665 | A | * | 2/1969 | Lingwood | 415/134 |
| 3,583,824 | A | * | 6/1971 | Smuland et al. | 415/117 |
| 3,867,061 | A | | 2/1975 | Moskowitz | 415/174 |
| 4,135,851 | A | | 1/1979 | Bill et al. | 415/174 |
| 4,409,054 | A | * | 10/1983 | Ryan | 156/293 |
| 4,529,355 | A | * | 7/1985 | Wilkinson | 415/173.1 |
| 4,666,371 | A | * | 5/1987 | Alderson | 415/197 |
| 4,867,639 | A | * | 9/1989 | Strangman | 415/173.4 |
| 5,228,195 | A | * | 7/1993 | Brown et al. | 29/888.3 |
| 5,281,089 | A | * | 1/1994 | Brown et al. | 415/173.1 |
| 5,304,031 | A | * | 4/1994 | Bose | 277/411 |
| 5,988,975 | A | * | 11/1999 | Pizzi | 415/139 |
| 6,251,494 | B1 | * | 6/2001 | Schreiber | 428/116 |
| 6,468,026 | B1 | * | 10/2002 | Bonnoitt et al. | 415/9 |
| 6,499,943 | B1 | * | 12/2002 | Beeck et al. | 415/115 |
| 6,537,020 | B2 | * | 3/2003 | Humhauser | 415/173.1 |
| 6,619,913 | B2 | * | 9/2003 | Czachor et al. | 415/119 |
| 6,962,482 | B2 | * | 11/2005 | Tanaka | 415/173.1 |
| 2004/0151582 | A1 | * | 8/2004 | Faulkner | 415/173.1 |

FOREIGN PATENT DOCUMENTS

| | | |
|---|---|---|
| DE | 198 28 065 | 12/1999 |
| DE | 100 20 673 | 10/2001 |

* cited by examiner

RING STRUCTURE OF METAL CONSTRUCTION HAVING A RUN-IN LINING

The present invention is directed to a ring structure of metal construction for a rotor blade region of axial flow compressor and turbine stages.

BACKGROUND

With regard to the aerodynamic properties of axial flow compressor and turbine stages, it is crucial that a small and as constant as possible radial gap be maintained between the blade tips and the outer flow channel wall. This requires most importantly that the wall structure exhibit sufficient dimensional stability and geometric precision. It is critical that the geometry be altered as little as possible by thermal and mechanical influences. The mostly hot working gas should essentially act only on the interior side of the structure; losses due to leakage through the structure must be minimized. In steady-state operation, it is advantageous when the mostly thermally induced dimensional variation of the wall structure is adapted temporally and in terms of magnitude to that of the bladed rotor. Since mechanical contacting between the blade tips and the wall structure is hardly avoidable under certain applications of force, the interior side of the wall structure should be designed to be deformable, resilient and, accordingly, to have run-in capability, at least on the blade-tip side.

The German patent DE 100 20 673 C2 describes a ring structure of metal construction for the rotor blade region of axial flow compressor and turbine stages. The ring structure it discusses has an annular outer wall, which is designed as a closed, mechanically stable housing wall of the compressor or turbine stage. The ring structure it discusses also has an annular inner wall, as well as a connecting structure designed as a hollow-chamber structure, the connecting structure designed as a hollow-chamber structure being positioned in a sandwich-type arrangement between the outer wall and the inner wall. On one side, the connecting structure designed as a hollow-chamber structure is connected to the outer wall and, on the other side, to the inner wall. The annular chamber structure in accordance with German patent DE 100 20 673 C2 has an inner wall, which is interrupted over its circumference by a plurality of axially or primarily axially extending expansion joints. An inner wall segmented in this manner by expansion joints has the disadvantage that flow losses can occur. In addition, the complexity of the ring structure and thus the assembly as well as manufacturing outlay are increased by an inner wall segmented in this manner. Moreover, during operation, chipping off, washout or damage due to erosion can occur at the edges of the expansion joints, further increasing the flow losses.

SUMMARY OF THE INVENTION

Against this background, an object of the present invention is to devise a novel type of ring structure of metal construction.

The present invention provides a ring structure of metal construction for a rotor blade region of axial flow compressor and turbine stages, in particular in gas turbine engines, comprising an annular outer wall (11), an annular inner wall (12) that is spaced with very little radial clearance from the blade tips, and a connecting structure (13) positioned between the outer wall (11) and the inner wall (12) and designed as a hollow-chamber structure, the outer wall (11) being designed as a closed, mechanically stable housing wall of the compressor or turbine stage, and the connecting structure (13) designed as a hollow-chamber structure being connected to the outer wall (11) and the inner wall (12), wherein the inner wall (12), which is designed as a closed, mechanically stable structure that serves as an run-in lining for the blade tips, is made of a metal woven fabric and/or of a metal felt. In accordance with the present invention, the inner wall is designed as a closed, mechanically stable structure that is made of a metal woven fabric and/or of a metal felt and serves as a run-in lining for the blade tips. The metal woven fabric and/or the metal felt is preferably fabricated from a metal alloy that is oxidation-resistant at high temperatures, in particular an iron-, nickel- or cobalt-based alloy.

Along the lines of the present invention, a ring structure of metal construction is provided, whose inner wall has a closed design and is made of a metal woven fabric and/or of a metal felt. The closed structure of the inner wall makes it possible to minimize flow losses. In addition, the ring structure according to the present invention is simpler in design than the segmented design known from the related art. By using a metal woven fabric and/or a metal felt for the closed inner wall, it is possible, on the one hand, to achieve substantial mechanical stability, and, on the other hand, circumferential strain does not lead to the formation of cracks in the inner wall. The metal woven fabric and/or the metal felt is capable, namely, of absorbing thermally produced strains without resulting in the formation of cracks.

BRIEF DESCRIPTION OF THE DRAWINGS

The present invention is described in greater detail in the following on the basis of exemplary embodiments, without being limited thereto. Reference is made to the drawings, whose.

DETAILED DESCRIPTION

In the following, the present invention is described in greater detail with reference to FIG. 1 through 6.

Figure 1:
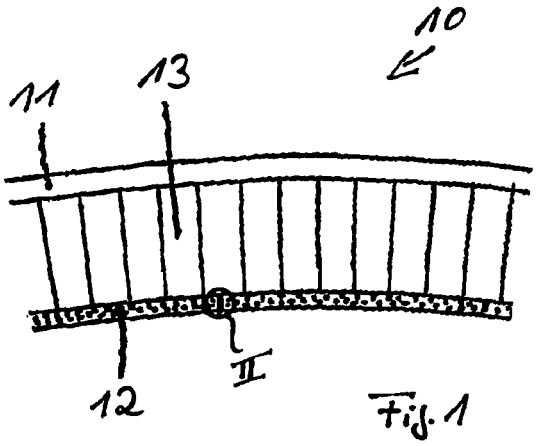
FIG. 1: shows a ring structure of metal construction according to the present invention in accordance with a first exemplary embodiment of the present invention in a schematic side view.
Figure 2:
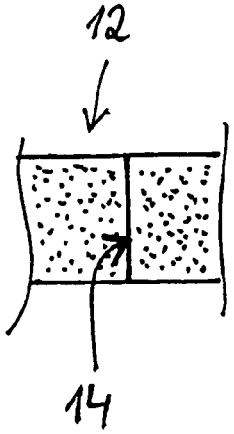
FIG. 2: shows detail II of the ring structure in accordance with FIG. 1.

FIGS. 1 and 2 show a first exemplary embodiment of a ring structure 10 according to the present invention, FIG. 2 illustrating detail II of FIG. 1 on an enlarged scale.

Ring structure 10 of the exemplary embodiment of FIGS. 1 and 2 includes a circular outer wall 11, a circular inner wall 12, as well as connecting structure 13 positioned in a sandwich-type arrangement between outer wall 11 and inner wall 12. Outer wall 11 is designed as a closed, mechanically stable housing wall of a compressor stage or turbine stage of a gas turbine, in particular of an aircraft engine. Connecting structure 13 positioned between outer wall 11 and inner wall 12 is designed as a hollow-chamber structure. In this context in cross section, hollow-chamber structure 13 may have hexagonal, rectangular or also round chambers, in one cross-sectional direction, disposed in parallel to the inner wall or outer wall of ring structure 10. Chambers that are hexagonal in cross section have a so-called honeycomb structure.

Along the lines of the present invention, inner wall 12 is designed as a closed and mechanically stable structure. Inner wall 12 serves, on the one hand, to mechanically stabilize ring structure 10 and, on the other hand, as a run-in lining for blade tips of rotating blades (not shown). Inner wall 12, which is designed along the lines of the present invention as an intrinsically closed structure, is made of a metal woven fabric and/or metal felt. In this context, a metal woven fabric is a structure in which metallic fibers or threads extend in a systematic pattern. On the other hand, a metal felt is a structure in which metallic fibers are oriented in a randomly or stochastically distributed pattern. The term metal woven fabric also refers to a knit mesh of metal fibers.

By using an intrinsically closed structure of metal woven fabric and/or metal felt as inner wall 12, one avoids gaps or joints within inner wall 12. This makes it possible to minimize flow losses. The metal woven fabric and/or the metal felt are capable of absorbing thermally produced strains without the danger of crack formation. This eliminates the need for expansion joints within inner wall 12. As a result, inner wall 12 designed as a closed structure has a simple design.

The sandwich-type structure made up of outer wall 11, inner wall 12, as well as of connecting structure 13 is permanently joined together. Thus, on one side, connecting structure 13 is permanently joined at the radially external end to outer wall 11 and, on the other side, at radially interior end to inner wall 12. Thus, connecting structure 13 may be soldered to inner wall 12 as well as to outer wall 11. In addition, it is possible to join connecting structure 13 to inner wall 12 and outer wall 11, for example by so-called surface diffusion welding or by sintering. Accordingly, outer wall 11, inner wall 12, as well as connecting structure 13 are permanently joined together to form an overall structure, namely ring structure 10 according to the present invention.

As already mentioned, inner wall 12 serves, on the one hand, to mechanically stabilize ring structure 10 according to the present invention and, on the other hand, as a run-in lining. In this connection, it should also be noted that inner wall 12 and, accordingly, the metal woven fabric and/or the metal felt of inner wall 12, are made of a material that is oxidation-resistant at high temperatures. Thus, the metal woven fabric or the metal felt may, for example, be fabricated from a metal alloy based on a nickel material, iron material or also a cobalt material.

The metal woven fabric and/or the metal felt is joined together, forming at least one butt joint abutting transitionally on annular inner wall 12. Thus, FIGS. 1 and 2 show a butt joint 14 of two mutually contiguous edges of the metal woven fabric and/or of the metal felt which is used to produce inner wall 12. In the exemplary embodiment of FIG. 2, the edges of butt joint 14 extend radially, so that the two edges are, in fact, mutually contiguous in the area of butt joint 14, but do not overlap.

FIG. 3 through 6 show two other exemplary embodiments of ring structures 15 and 16 according to the present invention. The exemplary embodiments of FIG. 3 through 6 differ from the exemplary embodiment of FIGS. 1 and 2 merely in the formation of the butt joint in the region of inner wall 12. The exemplary embodiments correspond in all other details, so that the same reference numerals are used for equivalent subassemblies to avoid unnecessary repetition.

Figure 3:
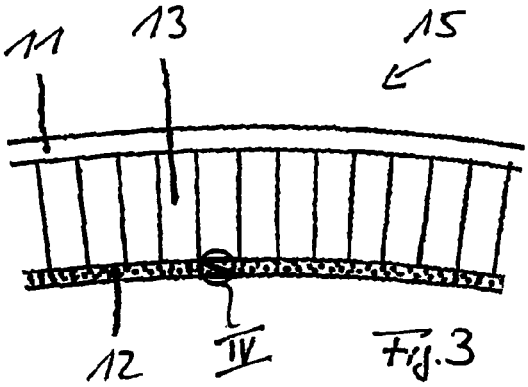
FIG. 3: shows a ring structure of metal construction according to the present invention in accordance with a second exemplary embodiment of the present invention in a schematic side view.
Figure 4:
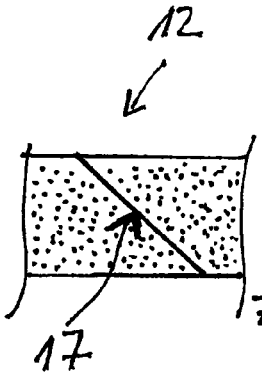
FIG. 4: illustrates detail IV of the ring structure in accordance with FIG. 3.

In the exemplary embodiment of FIGS. 3 and 4, a butt joint 17 is shown which extends obliquely to the radial direction; thus, on the one hand, it extends radially and, on the other hand, in the circumferential direction of ring structure 15. In the case of a butt joint 17 formed in this manner, the corresponding edges overlap without any thickening of material.

Figure 5:
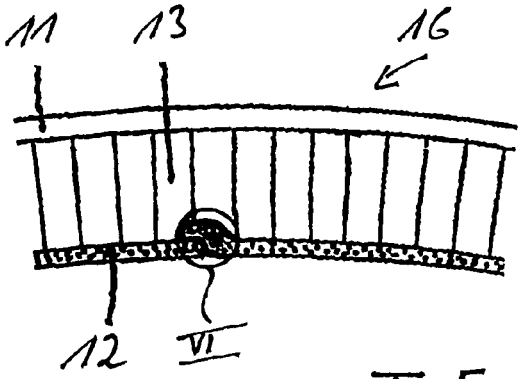
FIG. 5: depicts a ring structure of metal construction according to the present invention in accordance with a third exemplary embodiment of the present invention in a schematic side view.
Figure 6:
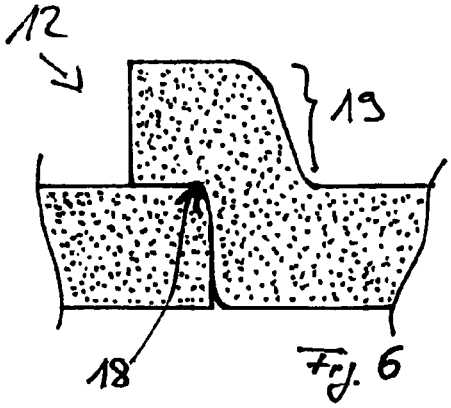
FIG. 6: shows detail VI of the ring structure in accordance with FIG. 5.

FIGS. 5 and 6 show an exemplary embodiment of a ring structure 16 according to the present invention which, in the region of inner wall 12, has a butt joint 18 whose mutually abutting edges overlap one another, forming a region of thickened material 19. As is inferable from FIGS. 5 and 6, region of thickened material 19 is directed radially outwardly in this context; accordingly, region of thickened material 19 extends into the region of connecting structure 13. The chambers of connecting structure 13 may be shortened in conformance therewith in the region in which region of thickened material 19 extends.

Along the lines of the present invention, a metallic ring structure is provided, whose inner wall is closed and, in addition, is fabricated from a metal woven fabric and/or a metal felt. The closed structure of the inner wall makes it possible to minimize flow losses. Through the use of the metal woven fabric and/or metal felt, it is possible to resist thermal expansion while ensuring freedom from cracks. As a result, a substantially simpler design of a ring structure is made possible. In addition, the inner wall made of the metal felt and/or of the metal woven fabric serves as a run-in lining.

What is claimed is:

1. A ring structure of metal construction for a rotor blade region of axial flow compressor and turbine stages comprising:

an annular outer wall;

an annular inner wall spaced adjacent with a radial clearance from blade tips of the rotor blade region;

a connecting structure positioned between the outer wall and the inner wall and designed as a hollow-chamber structure, the outer wall being designed as a closed, mechanically stable housing wall of the compressor or turbine stage, the connecting structure connected to the outer wall and the inner wall, and the inner wall forming a run-in lining coating for the blade tips, the inner wall being designed as a whole as a closed, continuous and mechanically stable structure of at least one of a metal woven fabric and a metal felt; and wherein the at least one of the metal woven fabric and the metal felt form the intrinsically closed, annular inner wall, the at least one of the metal woven fabric and the metal felt being joined to one another to form at least one butt joint abutting transitionally on the annular inner wall.

2. The ring structure as recited in claim 1 wherein the at least one of the metal woven fabric and the metal felt is fabricated from a metal alloy oxidation-resistant at high temperatures.

3. The ring structure as recited in claim 2 wherein the alloy is an iron-, nickel- or cobalt-based alloy.

4. The ring structure as recited in claim 1 wherein the at least one butt joint is formed in each instance by two opposing edges.

5. The ring structure as recited in claim 4 wherein the two opposing edges overlap each other.

6. The ring structure as recited in claim 5 wherein the edges overlap one another without forming a region of thickened material.

7. The ring structure as recited in claim 5 wherein the edges overlap one another, forming a region of thickened material, the region of thickened material being directed radially outwardly toward the connecting structure.

8. The ring structure as recited in claim 1 wherein the inner wall is permanently joined to the connecting structure by sintering or by surface-diffusion welding.

9. The ring structure as recited in claim 8 wherein the connecting structure is permanently joined to the outer wall by sintering or by surface-diffusion welding.

10. The ring structure as recited in claim 1 wherein the inner wall made of the at least one metal woven fabric and the metal felt is permanently joined to the connecting structure by soldering.

11. The ring structure as recited in claim 10 wherein the connecting structure is permanently joined to the outer wall by soldering.

12. A gas turbine engine comprising the ring structure as recited in claim 1.

13. A ring structure of metal construction for a rotor blade region of axial flow compressor and turbine stages comprising:

an annular outer wall;

an annular inner wall spaced adjacent with a radial clearance from blade tips of the rotor blade region;

a connecting structure positioned between the outer wall and the inner wall and designed as a hollow-chamber structure, the outer wall being designed as a closed, mechanically stable housing wall of the compressor or turbine stage, the connecting structure connected to the outer wall and the inner wall, and the inner wall forming a run-in lining coating for the blade tips, the inner wall being designed as a closed, continuous and mechanically stable structure of at least one of a metal woven fabric and a metal felt, the metal woven fabric or metal felt directly contacting the connecting structure; and wherein the at least one of the metal woven fabric and the metal felt form the intrinsically closed, annular inner wall, the at least one of the metal woven fabric and the metal felt being joined to one another to form at least one butt joint abutting transitionally on the annular inner wall.

* * * * *